US008156660B2

(12) United States Patent
Carow

(10) Patent No.: US 8,156,660 B2
(45) Date of Patent: Apr. 17, 2012

(54) APPARATUS AND METHOD FOR DRYING CLOTHES

(75) Inventor: James Phillips Carow, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1578 days.

(21) Appl. No.: 11/233,242

(22) Filed: Sep. 22, 2005

(65) Prior Publication Data

US 2007/0062061 A1 Mar. 22, 2007

(51) Int. Cl.
*F26B 11/02* (2006.01)

(52) U.S. Cl. ..... 34/485; 34/486; 34/495; 68/16 C; 68/19.2; 200/16

(58) Field of Classification Search ..... 34/380, 34/443, 595, 600, 485, 486, 495, 604, 664; 700/16; 200/16; 68/16 C, 19.2
See application file for complete search history.

(56) References Cited

U.S. PATENT DOCUMENTS

| | | | | |
|---|---|---|---|---|
| 3,203,679 | A | 8/1965 | Williams | |
| 3,286,361 | A | 11/1966 | Cobb et al. | |
| 3,612,500 | A | 10/1971 | Cramer et al. | 263/33 |
| 3,942,265 | A | 3/1976 | Sisler et al. | 34/45 |
| 4,231,166 | A | 11/1980 | McMillan | 34/48 |
| 4,286,391 | A | 9/1981 | Gerry | 34/44 |
| 4,397,101 | A * | 8/1983 | Rickard | 34/486 |
| 5,050,313 | A * | 9/1991 | Wakaeya et al. | 34/454 |
| 5,347,727 | A | 9/1994 | Kim | |
| 5,443,541 | A | 8/1995 | St. Louis | 34/486 |
| 6,141,887 | A | 11/2000 | Chen et al. | |
| 6,745,495 | B1 * | 6/2004 | Riddle et al. | 34/497 |
| 6,751,888 | B2 | 6/2004 | Lueckenback | 34/595 |
| 6,757,988 | B2 | 7/2004 | Bruntz et al. | 34/543 |
| 6,931,759 | B2 | 8/2005 | Jeong et al. | 34/485 |
| 6,995,965 | B2 * | 2/2006 | Hameed et al. | 361/91.1 |
| 7,020,985 | B2 * | 4/2006 | Casey et al. | 34/595 |
| 7,228,647 | B2 * | 6/2007 | Hong | 34/596 |
| 2007/0062061 | A1 * | 3/2007 | Carow | 34/443 |

FOREIGN PATENT DOCUMENTS

| | | | |
|---|---|---|---|
| EP | 0763618 | A2 | 3/1997 |
| EP | 1408151 | A1 | 4/2004 |
| EP | 1939349 | A2 * | 7/2008 |
| GB | 2279448 | A | 4/1995 |
| JP | 01303200 | A * | 12/1989 |
| JP | 02264698 | A * | 10/1990 |
| JP | 09056992 | A | 3/1997 |
| WO | 02/057533 | A1 | 7/2002 |
| WO | 02/079561 | A1 | 10/2002 |
| WO | 03/035962 | A1 | 5/2003 |

* cited by examiner

*Primary Examiner* — Stephen M. Gravini
(74) *Attorney, Agent, or Firm* — Clifton G. Green; McGarry Bair PC

(57) ABSTRACT

A method and apparatus for drying clothes by adjusting the heat input into a drying chamber of a clothes dryer based on the airflow rate through the drying chamber.

27 Claims, 8 Drawing Sheets

APPARATUS AND METHOD FOR DRYING CLOTHES

BACKGROUND OF THE INVENTION

1. Field of the Invention

The invention relates generally to automatic clothes dryers. In one aspect, the invention relates to a method of introducing heat for drying clothes in a clothes dryer comprising controlling the output of a dryer heating system based on an airflow rate through the dryer airflow system. In another aspect, the invention relates to an automatic clothes dryer having a controller for controlling operation of the dryer heating system relative to an airflow rate through the dryer airflow system.

2. Description of the Related Art

Automatic clothes dryers are well known, and typically comprise a cabinet enclosing a horizontally rotating drum accessible through an access door at the front of the cabinet for holding clothing items to be dried. An electric heater is frequently utilized and is positioned in an air inlet assembly upstream of the drum for heating the drying air prior to its entry into the drum. The drying air is delivered to the drum through a motor-driven blower assembly.

The temperature to which the air must be heated is dependent upon several factors, such as the fabric type being dried, the degree of dryness desired, the airflow through the dryer drum, and the size of the dryer load. Control of the air temperature typically involves controlling the operation of the heater and, thus, the electric power delivered to the heater. When the air temperature must be increased, the heater is turned on. When the air temperature must be decreased, the heater is turned off.

Traditional clothes dryers use thermostats to cycle a single heater element on and off. However, thermostats are capable of only two operating modes; i.e. full on or full off. Thus, the power delivered to the heater cycles between a preselected full power value and zero power. However, cycling between full power and zero power is an inefficient use of power, can contribute to increased drying times, can be hard on heater components, and does not provide satisfactory control for many fabric types and airflow conditions.

SUMMARY OF THE INVENTION

A method of introducing heat for drying clothes in a clothes dryer comprising a drying chamber for holding the clothes, an airflow system for delivering air through the drying chamber, and a heating system for heating the air in the airflow system, comprises controlling the output of the heating system based on the airflow rate through the airflow system. In another embodiment, an automatic clothes dryer for drying clothes comprises a drying chamber for holding the clothes, an airflow system for delivering air through the drying chamber a heating system comprising at least one heating element for heating the air in the airflow system, at least one sensor for determining an airflow rate through the airflow system, and a controller for controlling operation of the heating system relative to the airflow rate through the airflow system.

DESCRIPTION OF AN EMBODIMENT OF THE INVENTION

Figure 1:
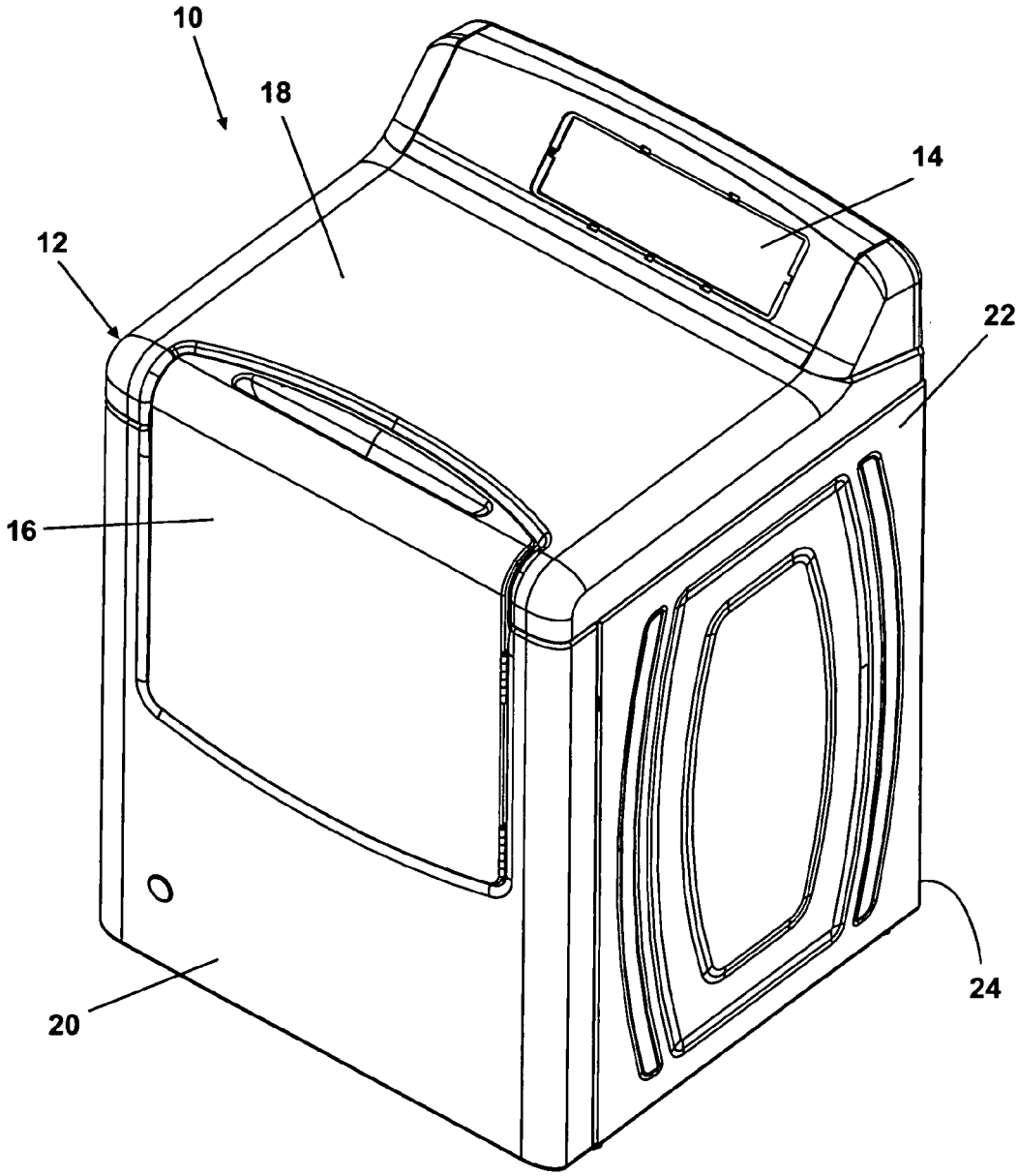
FIG. 1 is a perspective view of an automatic clothes dryer comprising a cabinet enclosing a rotating drum, a blower assembly, a heater, and temperature sensors according to the invention.

Referring to the Figures, and in particular to FIG. 1, an embodiment of an automatic clothes dryer 10 according to the invention is illustrated comprising a cabinet 12 having a user interface 14 for receiving user inputs such as garment type, drying temperature, and drying cycle duration, a door 16 hingedly attached to a front wall 20 of the cabinet 12, a rear wall 24, and a pair of side walls 22 supporting a top wall 18. The clothes dryer 10 described herein shares many features of a well-known automatic clothes dryer, and will not be described in detail except as necessary for a complete understanding of the invention.

Figure 2:
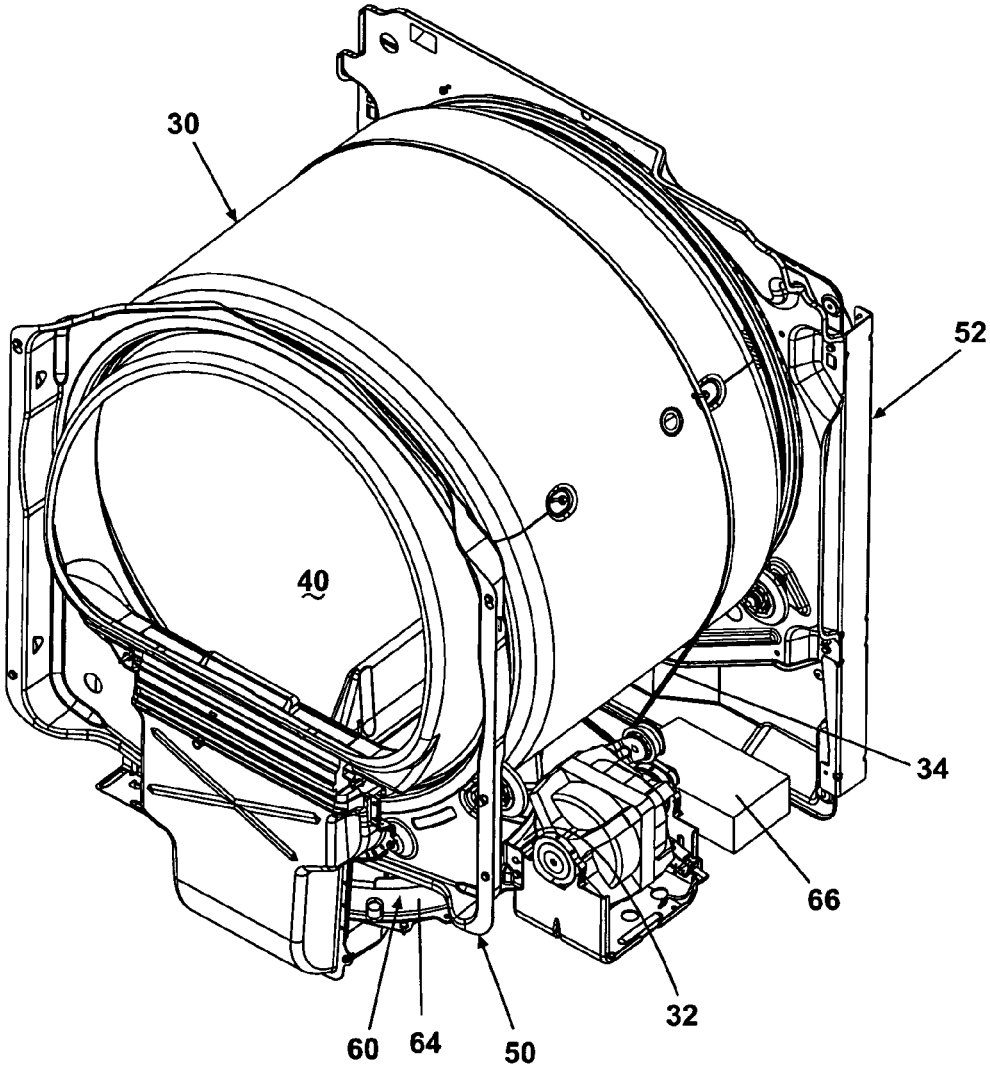
FIG. 2 is a perspective view of the automatic clothes dryer illustrated in FIG. 1 with portions removed for clarity, illustrating the internal components.

FIG. 2 illustrates the dryer 10 with the cabinet 12 removed to disclose the interior of the dryer 10, which comprises a rotating drum 30 rotatably suspended in a well-known manner between a front drum panel 50 and a rear drum panel 52. The front drum panel 50 is provided with an opening for access to the interior of the drum 30 which defines a drying chamber 40. The cabinet 12 also encloses a drum motor assembly 32 adapted in a well-known manner for rotating the drum 30 via a drum belt 34, and a blower assembly 60, which is partially visible beneath the drum 30.

Figure 3:
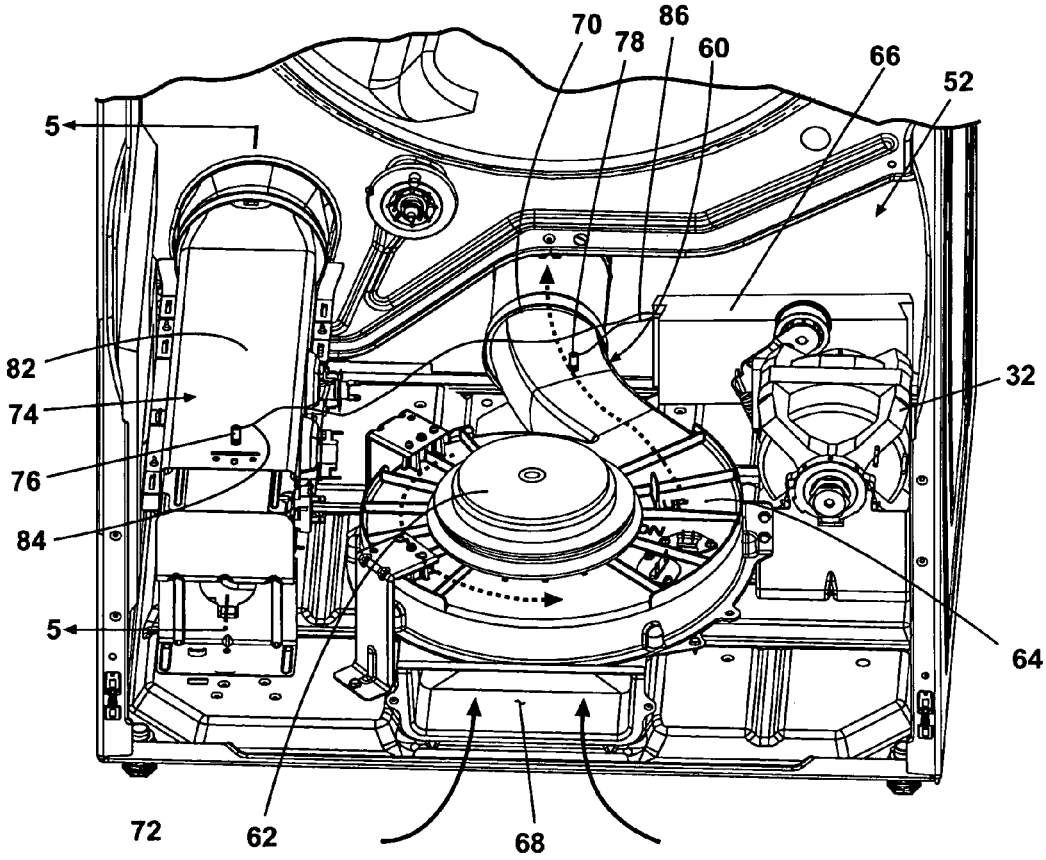
FIG. 3 is a perspective view of the blower assembly, including an air heating assembly and temperature sensors, illustrated in FIG. 2.

The blower assembly 60 is more clearly illustrated in FIG. 3, wherein the drum 30 is removed for clarity. The blower assembly 60 comprises a blower motor 62, a blower 64, and a controller 66. The blower 64 is illustrated as a centrifugal blower comprising a rotating impeller (not shown) enclosed in a housing which is configured to draw in air coaxially and exhaust the air tangentially in a direction orthogonal to the direction of airflow through the impeller. However, other blower types can be employed. Furthermore, the drum motor assembly 32 can be adapted to drive both the blower 64 and the drum 30, thereby eliminating the blower motor 62.

Figure 4:
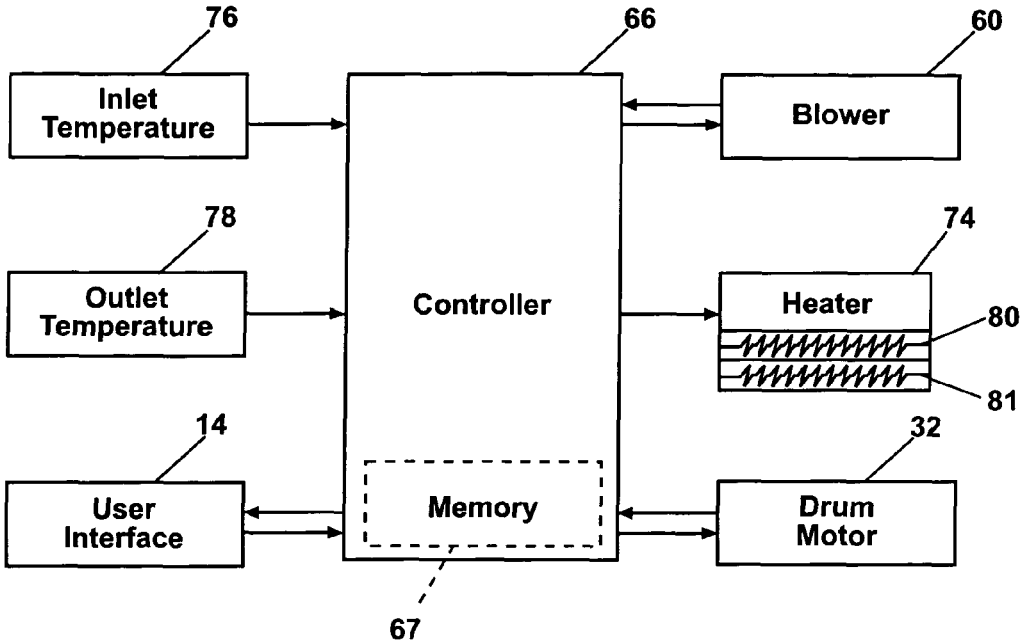
FIG. 4 is a schematic representation of the automatic clothes dryer of FIG. 1 illustrating a blower assembly, a heater, a drum assembly, temperature sensors, a user interface, and a controller.

Referring also to FIG. 4, the controller 66 comprises suitable memory 67 for receiving, storing, and providing data for processing in the controller 66. This data is provided by one or more temperature sensors 76, 78, the user interface 14, the blower assembly 60, the drum motor assembly 32, and a heater 74.

After passing through the drying chamber 40, air is drawn into the blower 64 through a blower inlet 68, as illustrated by the solid line flow vectors, and through the blower housing, as illustrated by the dotted line flow vectors, to exit a blower outlet 70 which is fluidly attached to a flexible dryer vent hose or similar conduit (not shown). Air entering the drying chamber 40 first passes through a dryer air inlet 72 entering into a heater assembly 74 for heating air prior to its entry into the drying chamber 40. The heater assembly 74 is fluidly connected to the drying chamber 40 through suitable inlet and outlet opening in the rear drum panel 52 and a connecting passageway. Thus, air is drawn through the inlet 72 into the heater assembly 74, and on into the drying chamber 40 by the blower assembly 60. The air then passes out of the drying chamber 40 through a passageway (not shown) in the front drum panel 50, through the blower assembly 60 to be exhausted through the dryer vent hose. The entire assembly from the dryer air inlet 72 to the dryer vent hose, including the drying chamber 40, comprises an airflow system for moving air through the drying chamber 40 to dry the clothes.

Figure 5:
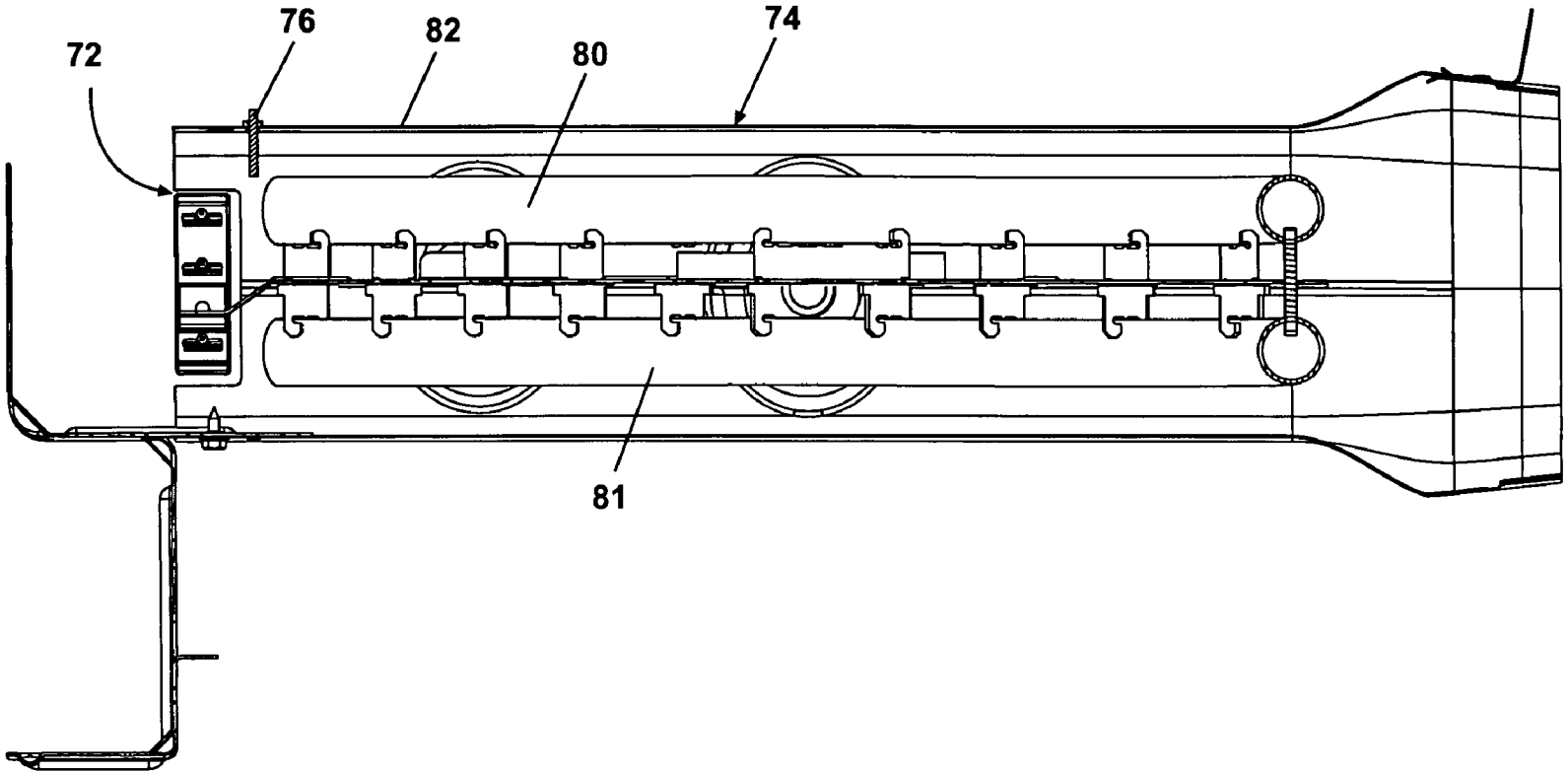
FIG. 5 is a sectional view of the air heating assembly and temperature sensor of FIG. 3 taken along line 5-5.

Referring to FIG. 5 the heater 74 comprises a dual element heater having an upper heater element 80 and a lower heater element 81. The heater elements 80, 81 can be of equal wattage, or of different wattage, with the higher wattage element serving as the primary heater element. Although the heater elements 80, 81 are illustrated as stacked vertically, other configurations can be utilized, such as side-by-side, and front-to-rear. The heating elements 80, 81 are separately controlled by a controller 66. The controller 66 comprises a well-known control device, such as a microprocessor, the digital memory 67 for storing data from various sensors, and interfaces for suitable communication devices, such as displays, alarms, keypads, and the like. Thus, the heating elements 80, 81 can be operated simultaneously to provide a maximum level of heat, a single heating element can be operated to provide an intermediate level of heat, or both elements can be shut off. The heater 74 can alternatively comprise multiple heater elements numbering more than two for increased temperature control and/or output, operated in general principle with the embodiment described herein.

The heater assembly 74 is adapted for mounting of a conventional inlet temperature sensor 76, such as a thermistor, for monitoring the temperature at a selected location within the heater assembly 74. In the embodiment described herein, the temperature sensor output is utilized to generate digital data that is proportional to the temperature.

As illustrated in both FIGS. 3 and 5, the inlet temperature sensor 76 is illustrated as mounted in a top wall 82 of the heater assembly 74 intermediate the inlet 72 and a pair of heating elements 80, 81, i.e. upstream of the heating elements 80, 81. Alternatively, the inlet temperature sensor 76 can be mounted downstream of the heating elements 80, 81, or in one of the other heater assembly walls. The mounting location of the inlet temperature sensor 76 is selected in order to accurately sense the change in temperature during heating of the heating elements 80, 81 and the flow of air through the heater assembly 74.

As illustrated in FIG. 3, an exhaust temperature sensor 78 can be similarly mounted in the blower assembly 60 intermediate the blower 64 and the blower outlet 70. Electrical leads 84, 86 from each sensor 76, 78, respectively, are connected to the controller 66.

The temperature sensor 76 is utilized to determine airflow through the clothes dryer 10. The temperature sensor 78 is used to monitor a dryness condition of the dryer load, and can be used with the information provided by the temperature sensor 76 to determine air leakage into the clothes dryer 10. While the airflow rate is described as being determined by the temperature sensor, the determination of airflow can be accomplished in different ways, and the particular manner and apparatus utilized is not germane to the invention. In the embodiment described herein, the output from the temperature sensors 76, 78 is utilized in a control system as described in U.S. patent application Ser. No. 11/033,658, filed Jan. 12, 2005, and entitled "Automatic Dryer with Variable Speed Motor," whose disclosure is incorporated by reference, and the airflow is determined as described in U.S. patent application Ser. No. 11/160,433, filed Jun. 23, 2005, and entitled "Automatic Clothes Dryer," whose disclosure is incorporated by reference. Examples of other suitable airflow sensors would include pressure sensors comparing the difference in the ambient air pressure and the pressure in the airflow system and traditional airflow meters comprising a turbine or similar device.

The inlet temperature sensor 76 is also utilized to regulate one of the heater elements 80, 81 with a conventional high-limit thermostat used to regulate the second heater element 81, 80. Alternatively, a second inlet temperature sensor (not shown) can be used to regulate the second heater element. Well-known dryer safety and/or control devices, such as high-limit thermostats, thermal cut-outs, and operating thermostats can also be utilized in the airflow system in conjunction with the temperature sensors 76, 78.

Referring again to FIG. 4, the controller 66 is used to determine an airflow, and the airflow value is then used by the controller 66 to select temperature sensor reset temperature values based upon the airflow. It is anticipated that the temperature trip point will remain constant for all airflow values, and that the reset temperature values will be varied based upon airflow. The controller 66 can also select predetermined operation modes in order to maintain power into the heater assembly 74, thereby maintaining heat into the drying chamber 40, while controlling the air temperature within preselected limits. These operation modes are achieved through selection of appropriate high-limit thermostat trip and reset temperature characteristics, and temperature sensor temperature limits for controlling the heater elements 80, 81 in order to optimize input energy to the heater assembly 74 with temperature at the inlet to the drying chamber 40.

Figure 6A:
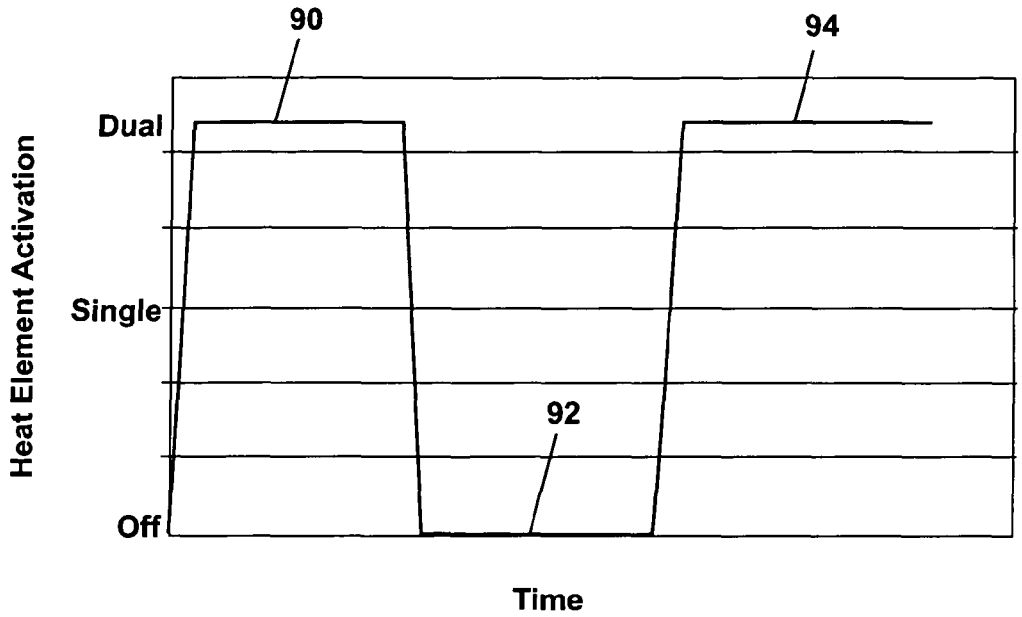
FIG. 6A is a graphical representation of a first dual element heater operation mode for the air heating assembly illustrated in FIG. 5.

FIGS. 6A-F illustrates several dual element heater operation modes for the heater assembly 74. FIG. 6A illustrates a first mode in which both heater elements 80, 81 are operated simultaneously 90 or switched off 92. Thus, air temperature control is effected by operating both heater elements 80, 81 simultaneously 90 for a preselected time interval or until the air temperature reaches a preselected maximum value, at which time both heater elements 80, 81 are switched off 92. The heater elements 80, 81 remain off for a preselected time interval or until the air temperature reaches a preselected minimum value, at which time both heater elements 80, 81 are again operated 94. This mode is utilized by prior art dryers, and produces the most variation in heater element input power.

Figure 6B:
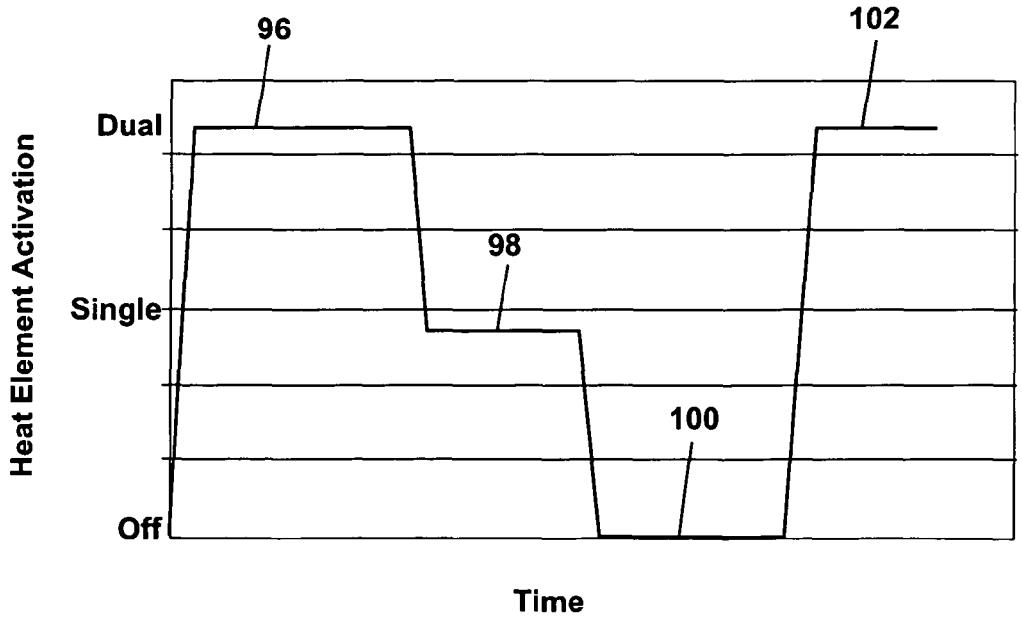
FIG. 6B is a graphical representation of a second dual element heater operation mode for the air heating assembly illustrated in FIG. 5.

FIG. 6B illustrates a second mode in which both heater elements 80, 81 are operated simultaneously 96 for a preselected time interval or until the air temperature reaches a preselected maximum value. One of the heater elements 80, 81 is then switched off 98, enabling the air temperature to decrease to a preselected value, but at a slower rate. If air temperature conditions require it, the second heater element can be switched off 100, thereby enabling the air temperature to further decrease. However, upon reaching a preselected reset temperature value, both heater elements 80, 81 are switched on 102.

Both of these modes are undesirable because they are an inefficient use of power, can contribute to increased drying times, can be hard on heater components, and do not provide satisfactory control for many fabric types and airflow conditions.

Figure 6C:
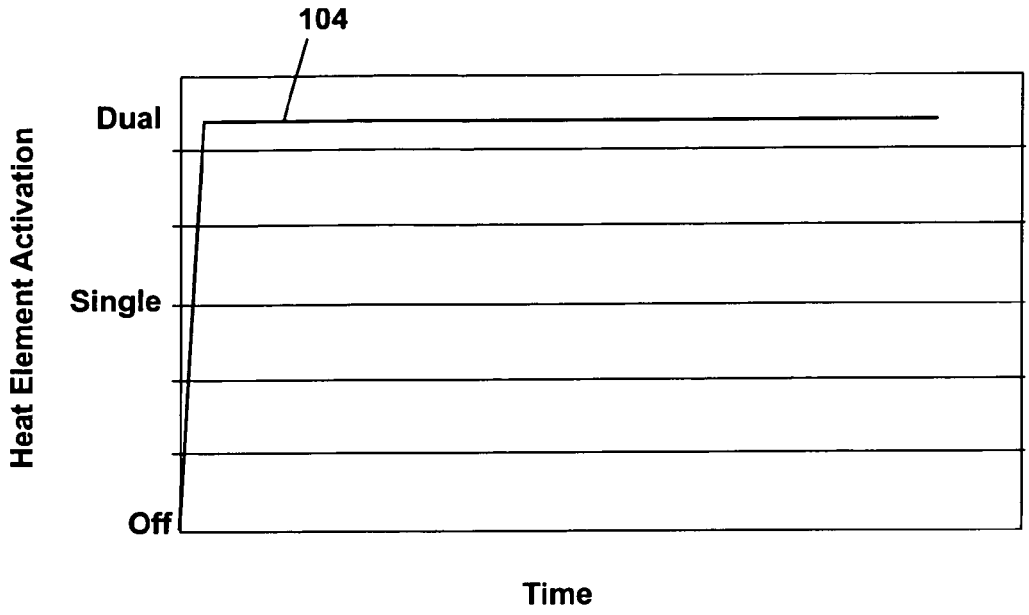
FIG. 6C is a graphical representation of a third dual element heater operation mode for the air heating assembly illustrated in FIG. 5.

FIG. 6C illustrates a third mode in which both heater elements 80, 81 are operated simultaneously 104. This mode produces the highest power input to the dryer 10 and is desirable when the inlet airflow is relatively high, such as when there are no airflow restrictions within the airflow system. An analysis of this mode relative to a dryer having a preselected configuration of drum, blower assembly, heater assembly, and airflow system has indicated that this mode is appropriate for inlet airflows of greater than 35 scfm. It should be noted that the airflow rates are a function of the configuration of a particular dryer. The disclosed airflow rates relate to a test dryer used by the inventors. Thus, the airflow rates are machine dependent and are provided for general understanding and comparison between the various modes.

Figure 6D:
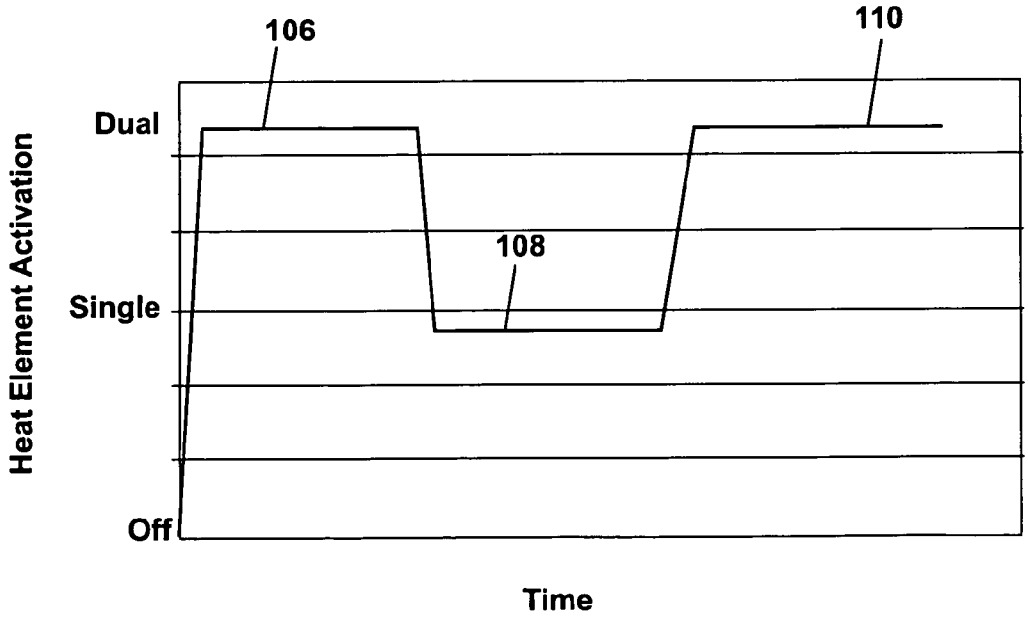
FIG. 6D is a graphical representation of a fourth dual element heater operation mode for the air heating assembly illustrated in FIG. 5.

FIG. 6D illustrates a fourth mode in which both heater elements 80, 81 are operated simultaneously 106 for a preselected time interval, or until the air temperature reaches a preselected maximum value. One of the heater elements 80, 81 is then switched off 108, thereby enabling the air temperature to decrease to a preselected value. The other of the heater elements 81, 80 remains on. Upon reaching a preselected reset temperature value, both heater elements 80, 81 are again switched on 110. The inlet temperature sensor 76 is utilized to regulate the input power by cycling the heater element 80, 81 off and on. This mode reduces the average inlet temperature to the drying chamber 40 and is desirable with an intermediate inlet airflow, corresponding to a moderate airflow restriction in the airflow system. An analysis of this mode relative to the test dryer indicated that this mode is appropriate for inlet airflows of between 35 scfm and 24 scfm.

Figure 6E:
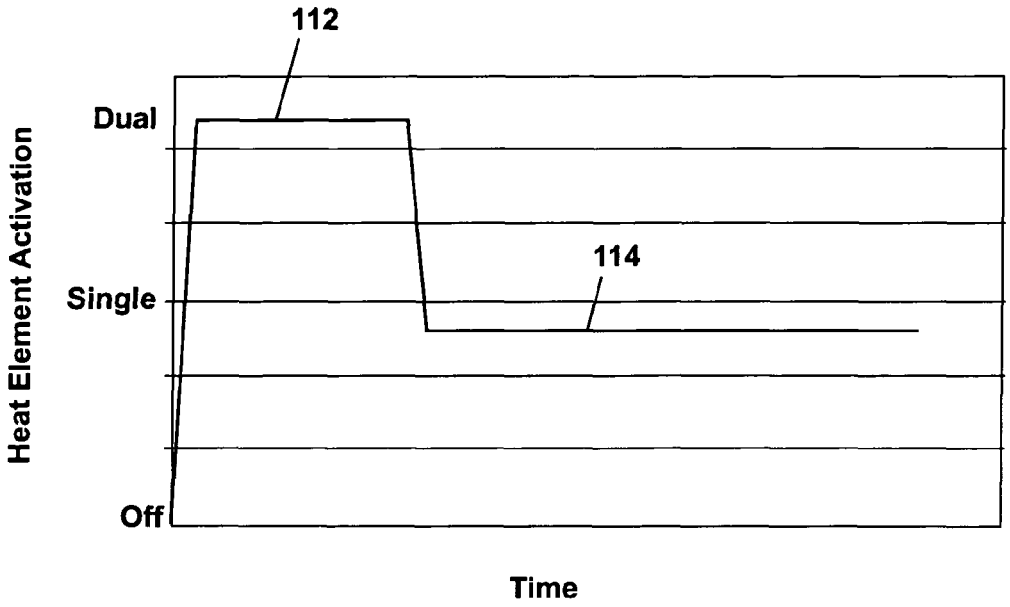
FIG. 6E is a graphical representation of a fifth dual element heater operation mode for the air heating assembly illustrated in FIG. 5.

FIG. 6E is a fifth mode in which both heater elements 80, 81 are operated simultaneously 112 for a preselected time interval, or until the air temperature reaches a preselected maximum value. One of the heater elements 80, 81 is then switched off 114 and remains off for the duration of the drying cycle. The inlet temperature sensor 76 is utilized to regulate the input power by cycling the heater element 80, 81 off. This mode maintains power to only one element 80, 81 of the heater assembly 74, and prevents high-limit cycling. This mode is desirable with a low inlet airflow corresponding to a high airflow restriction in the airflow system. An analysis of this mode relative to the test dryer indicated that this mode is appropriate for inlet airflows of less than 24 scfm.

Figure 6F:
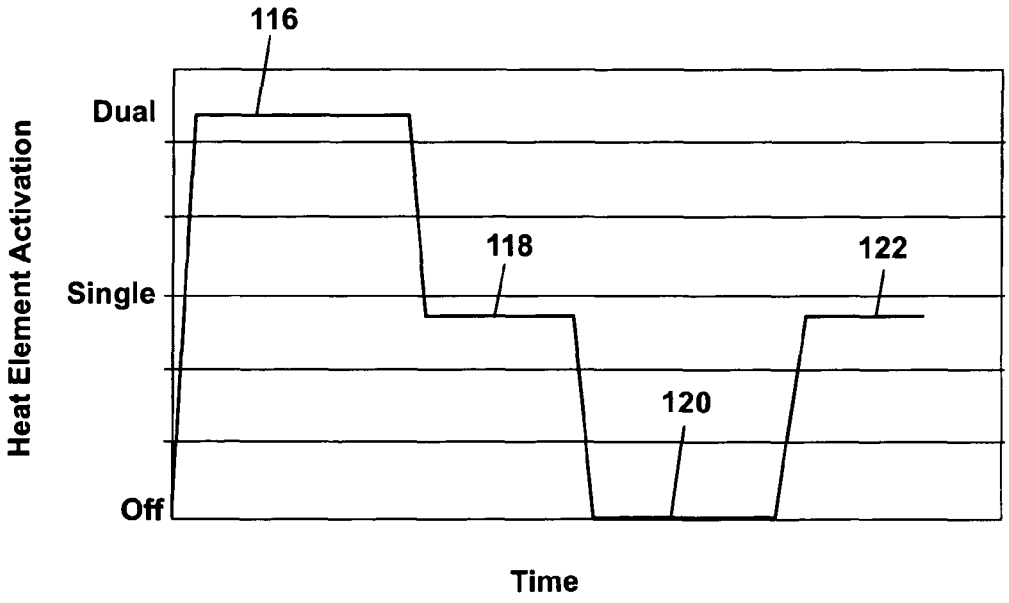
FIG. 6F is a graphical representation of a sixth dual element heater operation mode for the air heating assembly illustrated in FIG. 5.

FIG. 6F is a sixth mode in which both heater elements 80, 81 are operated simultaneously 116 for a preselected time interval, or until the air temperature reaches a preselected maximum value. One of the heater elements 80, 81 is then switched off 118, enabling the air temperature to decrease to a preselected value, but at a reduced rate. If air temperature conditions require it, the second heater element can be switched off 120, thereby enabling the air temperature to further decrease. Upon reaching a preselected reset temperature value, one of the heater elements 80, 81 is switched on 122. The other of the heater elements 80, 81 remains off for the duration of the drying cycle, with the active heater element cycled off and on. This mode is activated under very low inlet airflow conditions, when airflow is nearly completely restricted, and is controlled by the high-limit trip and reset temperature points. An analysis of this mode relative to the test dryer indicated that this mode is appropriate for inlet airflows of less than 16 scfm.

These modes can be modified to reduce heater input power for special cycles requiring less power. Each of these modes continues through the drying cycle until an exhaust side trip event, triggered, for example, by the exhaust temperature sensor 78 or a thermostat, occurs. At the reset point, the operation mode would be resumed at its previous operating condition, or, in the case of the third and fourth modes, could change to a single heater element mode, controlled by the exhaust temperature sensor 78 or thermostat, to reduce fabric temperatures.

The controller described herein improves power input regulation to a dual element heater which can adapt to changes in the inlet airflow or the transient rate of heating. The heater is controlled based on the inlet airflow conditions, which results in improved inlet temperature and fabric temperature management than is possible with exhaust side temperature control. The controller also eliminates the situation of zero power delivery to the heater under a wide range of operating conditions, which contributes to more consistent drying times. Finally, the control operation can be readily modified to more easily accommodate selected fabric care for different fabric types and/or based on a consumer-selected option.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of introducing heat for drying clothes in a clothes dryer comprising a drying chamber for holding the clothes, an airflow system for delivering air through the drying chamber, and a heating system for heating the air in the airflow system, the method comprising:

determining an airflow rate in the airflow system; and controlling the output of the heating system based on the determined airflow rate.

2. The method according to claim 1, wherein the heat output of the heating system is greater for greater airflow rates.

3. The method according to claim 2, wherein the heat output of the heating system is set according to ranges of airflow rates.

4. The method according to claim 3, wherein the heat output of the heating system is at least at a minimum output.

5. The method according to claim 4, wherein the heat output of the heating system is selectively increased from the minimum output.

6. The method according to claim 1, wherein the heat output of the heating system is controlled by energizing at least one of multiple heating elements.

7. The method according to claim 6, wherein the at least one of the multiple heating elements is continuously energized.

8. The method according to claim 7, wherein another of the multiple heating elements is alternately energized and deenergized during at least part of the time that the at least one of the multiple heating elements is continuously energized.

9. The method according to claim 8, wherein the at least one of the multiple heating elements and the other of the multiple heating elements are initially both energized.

10. The method according to claim 6, wherein the heating system comprises a first and a second heating element, both of which are initially energized.

11. The method according to claim 10, wherein the second heating element is deenergized while the first heating element is energized.

12. The method according to claim 11, wherein the first heating element is deenergized while the second heating element is deenergized.

13. The method according to claim 12, wherein both the first and second heating elements are energized after both the first and second heating elements are deenergized.

14. The method according to claim 13, wherein one of the first and second heating elements is energized after both heating elements are deenergized.

15. The method according to claim 1, wherein the airflow rate is determined at least at one portion of the airflow system.

16. The method according to claim 15, wherein the airflow rate is determined by sensing a parameter of the airflow.

17. An automatic clothes dryer for drying clothes comprising:

a drying chamber for holding the clothes;

an airflow system for delivering air through the drying chamber;

a heater for heating the air in the airflow system;

at least one sensor that senses a parameter of the airflow through the airflow system, and provides said parameter to a controller;

a controller operably coupled to the heater and the at least one sensor for determining an airflow rate through the airflow system from the parameter provided by the at least one sensor and controlling operation of the heater relative to the determined airflow rate through the airflow system.

18. The automatic clothes dryer according to claim 17, wherein the heater comprises multiple heating elements operably coupled to the controller.

19. The automatic clothes dryer according to claim 18, wherein the controller controls the heat output of the heater by controlling the energizing of at least one of the multiple heating elements.

20. The automatic clothes dryer according to claim 19, wherein the at least one of the multiple heating elements is continuously energized.

21. The automatic clothes dryer according to claim 20, wherein another of the multiple heating elements is alternately energized and deenergized during at least part of the time that the at least one of the multiple heating elements is continuously energized.

22. The automatic clothes dryer according to claim 21, wherein the at least one of the multiple heating elements and the other of the multiple heating elements are initially both energized.

23. The automatic clothes dryer according to claim 19, wherein the heater comprises a first and a second heating element, both of which are initially energized.

24. The automatic clothes dryer according to claim 23, wherein the second heating element is deenergized while the first heating element is energized.

25. The automatic clothes dryer according to claim 24, wherein the first heating element is deenergized while the second heating element is deenergized.

26. The automatic clothes dryer according to claim 25, wherein both the first and second heating elements are energized after both the first and second heating elements are deenergized.

27. The automatic clothes dryer according to claim 26, wherein one of the first and second heating elements is energized after both heating elements are deenergized.

* * * * *